United States Patent [19]

Mizuno et al.

[11] Patent Number: 4,627,748

[45] Date of Patent: Dec. 9, 1986

[54] WRITING-PLOTTING APPARATUS WITH KEYBOARD

[75] Inventors: Kenji Mizuno; Ryoichi Sasaki, both of Nagoya, Japan

[73] Assignee: Brother Kogyo Kabushiki Kaisha, Aichi, Japan

[21] Appl. No.: 714,478

[22] Filed: Mar. 21, 1985

[30] Foreign Application Priority Data

Mar. 27, 1984 [JP] Japan ..... 59-60261

[51] Int. Cl.[4] ..... B41J 3/04

[52] U.S. Cl. ..... 400/17; 346/33 R; 346/139 R; 364/520; 400/18

[58] Field of Search ..... 400/17, 18, 118, 279, 400/251, 253, 252; 346/33 R, 139 R; 364/520

[56] References Cited

U.S. PATENT DOCUMENTS

| | | | |
|---|---|---|---|
| 4,150,902 | 4/1979 | Brescia | 400/17 |
| 4,532,521 | 7/1985 | Onoda | 400/17 X |
| 4,542,384 | 9/1985 | Tazaki | 346/33 R |

FOREIGN PATENT DOCUMENTS

| | | | |
|---|---|---|---|
| 2232690 | 1/1974 | Fed. Rep. of Germany | 400/144.2 |
| 2941223 | 6/1981 | Fed. Rep. of Germany | 400/144.2 |

*Primary Examiner*—Paul T. Sewell

*Attorney, Agent, or Firm*—Parkhurst & Oliff

[57] ABSTRACT

A recording apparatus for writing characters in a writing mode and plotting graphs in a plotting mode, with a writing instrument supported on a reciprocating carriage, based on input data through a keyboard which is operable in a first mode in which at least numerals are keyed in, and in a second mode in which letters and symbols are keyed in. The apparatus comprises a control device for controlling a paper feeding device and the carriage, to write in the writing mode the characters which are keyed in through corresponding character keys with the keyboard placed selectively in the first mode or in the second mode, and to plot the graphs in the plotting mode based on the operations of the keys with the keyboard placed in the first mode. The apparatus further comprises a memory means for storing, upon selection of the plotting mode, mode data indicative of one of the first and second modes of the keyboard which has been established in the writing mode before the plotting mode is selected, and an automatic mode setting device for placing the keyboard into the first mode upon selection of the plotting mode, and placing the keyboard, upon selection of the writing mode, into the first or second mode which is represented by the mode data stored in the memory.

9 Claims, 6 Drawing Figures

FIG. 5a

S1: IS ANY KEY OPERATED?

S2: ANY FUNCTION KEY?

S3: "GRAPH" KEY ?

S4: "MODE" FLAG IS CHANGED TO CHANGE "WRITING" MODE TO "PLOTTING" MODE OR VICE VERSA.

S5: "KANA" KEY ?

S6: IS "KANA" MODE CURRENTLY ESTABLISHED ?

S7: "KANA" MODE IS ESTABLISHED.

S8: "KANA" MODE IS CANCELLED.

S9: "SHIFT" KEY ?

S10: FUNCTION OF OTHER FUNCTION KEY IS EXECUTED.

S11: "SHIFT" FLAG IS SET TO ESTABLISH "ENGLISH UPPER-CASE" MODE.

S12: IS "PLOTTING" MODE CURRENTLY ESTABLISHED ?

S13: IS "SHIFT" FLAG SET ?

S14: IS "KANA" MODE CURRENTLY ESTABLISHED ?

S15: CHARACTER PATTERN DATA IS READ OUT BASED ON KEYED-IN CODED DATA FROM THE KEYBOARD.

S16: KEYED-IN CODED DATA IS CONVERTED INTO CORRESPONDING "KANA-MODE" CODED DATA.

S17: CHARACTER PATTERN DATA IS READ OUT BASED ON THE CONVERTED CODED DATA.

S18: KEYED-IN CODED DATA IS CONVERTED INTO CORRESPONDING "UPPER-CASE MODE" CODED DATA.

S19: "PLOTTING" MODE OPERATION

WRITING-PLOTTING APPARATUS WITH KEYBOARD

BACKGROUND OF THE INVENTION

The present invention relates to a recording apparatus with a keyboard, capable of writing characters and plotting graphs on a recording medium with suitable writing imstruments, according to input data keyed in through the keyboard.

A recording apparatus is known, wherein graphs are plotted or drawn on a sheet of paper by relative movements of the sheet of paper and a writing instrument such as a ball-point pen.

Such a known recording apparatus, however, is not capable of writing various characters such as letters, numerals and symbols, by operating the corresponding character keys, and plural fuction keys disposed on a keyboard as provided on an ordinary typewriter.

In view of the above, the assignee of the present application developed a recording apparatus with a keyboard, which is capable of writing characters in a writing mode, and plotting graphs in a plotting mode, according to input data keyed in through the keyboard. This recording apparatus comprises (a) a keyboard having a multiplicity of keys including character keys corresponding to the characters, the keyboard being operable in a first mode in which at least numerals can be keyed in, and in a second mode in which letters and symbols can be keyed in; (b) a paper feeding device for supporting and feeding a sheet of paper in opposite directions; (c) a carriage supporting a writing instrument, and movable in a direction perpendicular to a line of feed of the sheet of paper; and (d) a control device for controlling the operations of the paper feeding device and the carriage, to write with the writing instrument in the writing mode the characters which are keyed in through the character keys, and to plot the graphs with the writing instrument in the plotting mode based on the operations of the multiplicity of keys on the keyboard.

The recording apparatus described above is advantageous in that the keyboard which is selectively placed in the first or second mode permits recording of a large number of different characters in the writing mode. In the plotting mode, however, the need of writing characters is relatively limited. Namely, an ordinary plotting operation in the plotting mode requires the writing of numbers (numerals), and a limited number of symbols such as decimal point.

If the first and second modes are available in the plotting mode as well as in the writing mode, the operator of the apparatus has to pay attention to the previously and currently selected modes of the keyboard and to the mode which will be selected, each time the mode of the apparatus is changed from the writing mode to the plotting mode or vice versa. This is cumbersome to the operator and may reduce the recording efficiency.

SUMMARY OF THE INVENTION

It is therefore an object of the present invention to provide a recording apparatus with a keyboard operable in a selected one of plural modes, which are capable of writing characters in a writing mode and plotting graphs in a plotting mode, without requiring the operator to pay attention to the modes of the keyboard when the mode of the apparatus is switched between the writing and plotting modes.

According to the present invention, there is provided a recording apparatus capable of writing characters in a writing mode and plotting graphs in a plotting mode, comprising: (a) a keyboard having a multiplicity of keys including character keys corresponding to the characters, the keyboard being operable in a first mode in which at least numerals can be keyed in, and in a second mode in which letters and symbols can be keyed in; (b) a paper feeding device for supporting and feeding a sheet of paper in opposite directions; (c) a carriage supporting a writing instrument, and movable in a direction perpendicular to a line of feed of the sheet of paper; (d) control means for controlling the operations of the paper feeding device and the carriage, to write with the writing instrument in the writing mode the characters which are keyed in through the character keys with the keyboard placed selectively in the first or second mode, and to plot the graphs with the writing instrument in the plotting mode based on the operations of the multiplicity of keys with the keyboard placed in the first mode; (e) mode-memory means for storing, upon selection of the plotting mode, mode data indicative of one of the first and second modes which has been established in the writing mode before the selection of the plotting mode; and (f) automatic mode setting means for placing the keyboard into the first mode upon the selection of the plotting mode, and placing the keyboard, upon selection of the writing mode, into the first or second mode which is represented by the mode data stored in the mode-memory means.

In the recording apparatus constructed as described above, the keyboard is placed in the first mode suitable for the plotting operation, when the recording apparatus is set in the plotting mode. This arrangement frees the operator from cumbersome attention to the modes of the keyboard for correct data input, when the mode of the apparatus is switched to the plotting mode.

Further, since the mode of the keyboard prior to selecting the plotting mode is stored in the mode-memory means when the mode of the apparatus is changed to the plotting mode, the keyboard is automatically placed into the first or second mode which is registered in the mode-memory means, when the apparatus is restored to the writing mode from the plotting mode. Hence, even if the keyboard is automatically placed in the first mode as a result of switching from the writing mode to the plotting mode while the keyboard is in the second mode, the keyboard is automatically restored to the previously established second mode when the recording apparatus is restored to the writing mode.

Should the mode of the keyboard be changed without the recognition by the operator when a plotting operation is inserted in a writing operation, the operator is required to manipulate the keyboard in order to reestablish the previously established mode of the keyboard each time the plotting mode is changed to the writing mode, so that data for the writing operation will not be entered erroneously. This manipulation to reestablish the intended mode of the keyboard is not only troublesome, but also may be even forgotten to be done by the operator, with a result of possible error in data entry through the keyboard. According to the present invention, however, the mode of the keyboard established after a plotting mode of operation is the same as the mode in which the keyboard had been placed before the plotting mode of operation was started. Accordingly, the instant recording apparatus does not suffer the above-indicated inconveniences. Furthermore, the automatic mode setting of the keyboard according to the invention, that is, using the same mode of the keyboard in the writing mode before and after a plotting mode of operation, is very much appreciated because of a considerably low practical requirement that two different kinds of letters should be used before and after an intervening plotting operation. For example, it is rare that lower-case alphabetic letters should be primarily used in a writing mode of operation, while alphabetic upper-case letters should be primarily used in a writing operation following the plotting operation. Similarly, it is not a frequent requirement that a writing operation preceding a plotting operation should be done in alphabetic letters, while a writing operation following the plotting operation be done, for example, in Japanese "kana" letters.

According to one embodiment of the invention, the first mode of the keyboard is a non-shift mode in which lower-case letters are keyed in through said character keys, and the second mode is a shift mode in which upper-case letters are keyed in through said character keys. To selectively establish these non-shift and shift modes, the keyboard has operator-controlled shift means for placing the keyboard in the shift mode. The keyboard is placed in the non-shift mode while the shift means is not operated.

In one form of the above embodiment, the operator-controlled shift means comprises a shift key operable between its non-shift position to select the non-shift mode, and its shift position to select the shift mode, and further has a lock key for locking the shift key in the shift position. The shift key locked by the lock key is unlocked when the lock key locking the shift key is operated.

According to another embodiment of the invention, the first mode of the keyboard is an English lower-case mode in which English lower-case letters are keyed in through the character keys, and the second mode of the keyboard includes an English upper-case mode in which English upper-case letters are keyed in through the character keys, and a special mode in which letters except the English lower-case and upper-case letters are keyed in through the character keys. The keyboard may have a mode selector key which selects the English upper-case mode while the mode selector key is operated, and further have another mode selector key for selecting the English lower-case mode and the special mode alternately upon repeated depression thereof.

In accordance with a further embodiment of the invention, the keyboard has a mode selector key for selecting the writing and plotting modes alternately upon repeated depression thereof.

According to a still further embodiment of the invention, the control means comprises: a character pattern memory storing sets of character pattern data representative of patterns of the characters; code data memory means for temporarily storing coded data received from the keyboard upon operation of each of the multiplicity of keys; code data discriminating means for checking whether the coded data corresponds to one of the character keys or one of function keys on the keyboard; mode discriminating means for checking whether the keyboard is currently placed in the first mode or in the second mode, if the checking by the code data discriminating means indicates that the coded data corresponds to one of the character keys; pattern-data processing means which, if the checking by the mode discriminating means indicates that the keyboard is placed in the first mode, reads out from the character pattern memory the set of character pattern data corresponding to the coded data stored in the code-data memory means, and if the checking by the mode discriminating means indicates that the keyboard is placed in the second mode, converts the coded data into corresponding second-mode coded data, and reads out from the character pattern memory the set of character pattern data corresponding to said second-mode coded data, the pattern-data processing means processing the read-out character pattern data for writing the characters represented by the read-out character pattern data; output means for providing output signals corresponding to the character pattern data processed by the pattern-data processing means; and driver means responsive to the output signals from the output means to drive the paper feeding device and the carriage.

In one form of the above embodiment, if the checking by the code-data discriminating means indicates that the coded data corresponds to one of the function keys, the automatic mode setting means checks whether said one of function keys is a mode selector key for establishing and cancelling the plotting mode. In this case, the automatic mode setting means operates when the checking thereby indicates that the operated one of the function keys is the mode selector key.

According to another embodiment of the invention, the mode-memory means stores the mode data irrespective of whether the recording apparatus is placed in the writing mode or in the plotting mode. The control means comprises a character pattern memory storing sets of character pattern data representative of the characters, and further comprises pattern-data processing means which, if the keyboard is placed in the second mode, converts the coded data into corresponding second-mode coded data, and reads out from the character pattern memory the set of character pattern data corresponding to said second-mode coded data. The automatic mode setting means inhibits the pattern-data processing means from converting the coded data into said second-mode coded data, irrespective of the contents of the mode data in the mode-memory means, while the recording apparatus is placed in the plotting mode.

BRIEF DESCRIPTION OF THE DRAWING

These and other objects and many attendant advantages of this invention will be readily appreciated as the same becomes better understood by reference to the following detailed description when considered in connection with the accompanying drawing, in which:

FIG. 5 is a flow chart representing a part of a control program that is closely associated with the subject matter of the present invention and FIG. 5*a* is a list of steps of operation in the flow chart of FIG. 5.

DETAILED DESCRIPTION OF THE PREFERRED EMBODIMENT

Referring to the accompanying drawing, a preferred embodiment of the invention will be described in detail.

Figure 1:
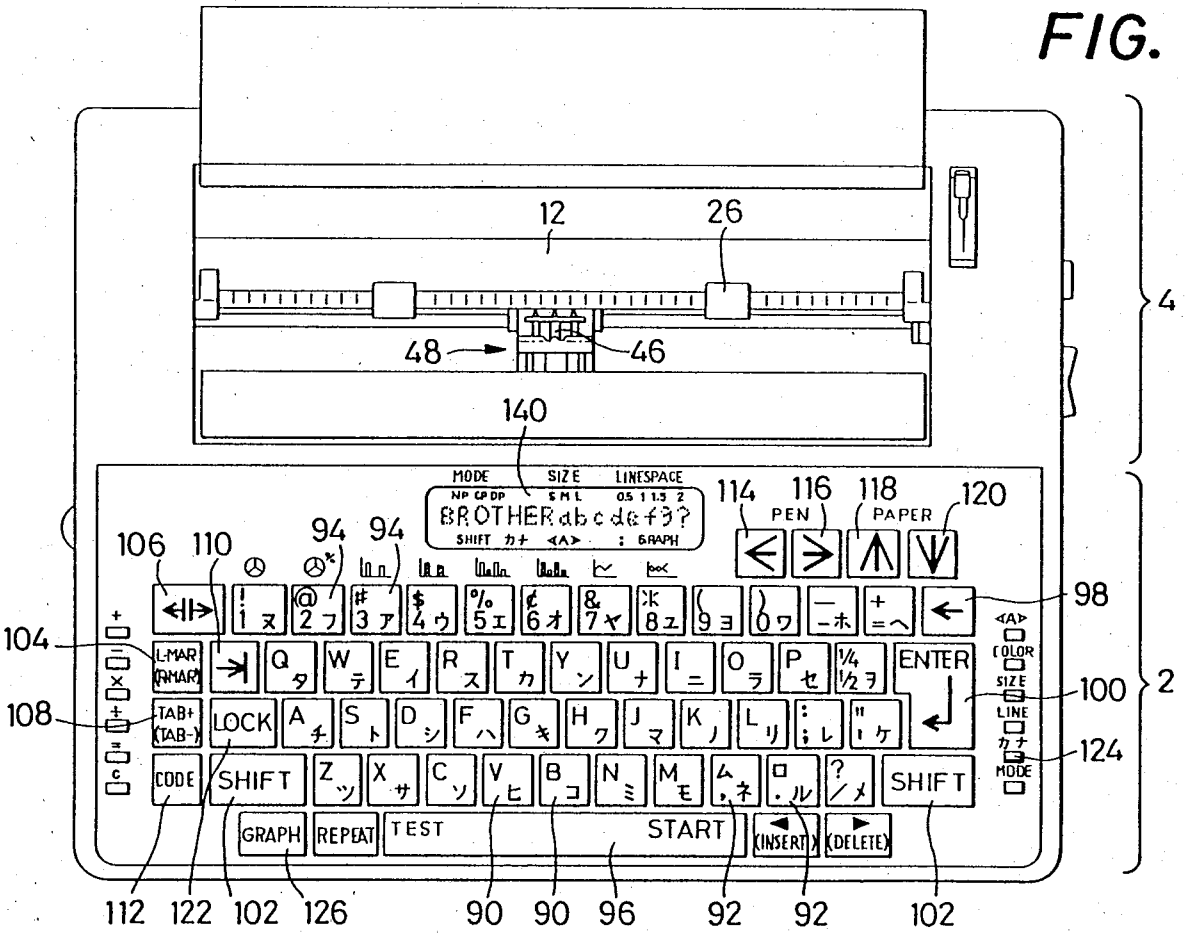
FIG. 1 is a schematic plan view of one embodiment of a recording apparatus of the invention having a keyboard and using ball-point pens as writing instruments.
Figure 2:
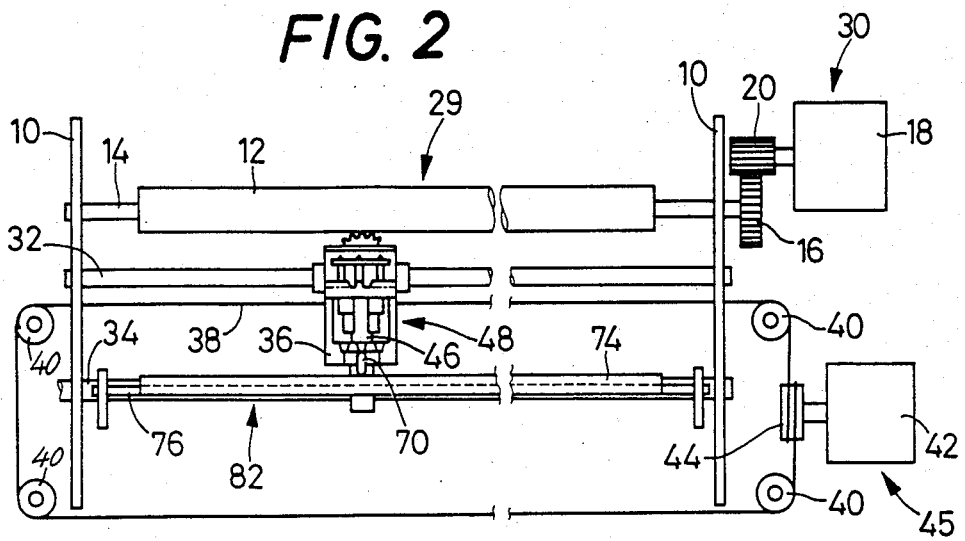
FIG. 2 is a schematic plan view in enlargement of a recording mechanism of the recording apparatus of FIG. 1.

In a plan view of FIG. 1, there is shown one embodiment of a recording apparatus of the invention which uses ball-point pens (described later) as writing instruments. The recording apparatus has a keyboard 2 at its front half, and a recording section 4 at its rear half. A recording mechanism of the recording section 4 is schematically illustrated in FIG. 2, wherein reference numerals 10 designate a pair of opposed side frames of a main housing structure of the apparatus. These side frames 10 support rotatably a shaft 14 of an elongate cylindrical platen 12 which serves as a paper support member. The shaft 14 has a gear 16 fixed to one end thereof. The gear 16 meshes with a pinion 20 which is fixed to an output shaft of a platen drive motor 18. The platen 12 is rotated by an angular amount as needed, by the motor 18 in selected one of opposite directions, i.e., either forward or reverse direction. The platen 12 cooperates with a paper pan 22, presser rollers 23, a paper guide 24, paper bail rollers 26 (shown in FIG. 3), and other parts, to constitute a paper supporting device 29 for guiding and supporting a sheet of recording paper 28 along the circumferential surface of the platen 12. On the other hand, the gear 16, platen drive motor 18, and pinion 20 constitute a major part of a paper feeding device 30 for feeding the sheet of paper 28 in the Y-axis direction perpendicular to an axis of rotation of the platen 12.

Two mutually parallel guide rods 32, 34 extend in parallel with the platen 12 between the opposed side frames 10. These two guide rods 32, 34 support a carriage 36 slidably along the length of the rods 32, 34. A carriage drive wire 38, which is fixed at its opposite ends to the carriage 36, is guided in a loop by four idler guide rollers 40. The drive wire 38 is wound on a drive pulley 44 fixed to an output shaft of a carriage drive motor 42. With bidirectional rotary movements of the drive motor 42, the loop of the drive wire 38 is rotated in the corresponding directions, whereby the carriage 36 is reciprocated in opposite directions along the axis of the platen 12, i.e., in the X-axis direction perpendicular to the Y-axis along which the sheet of paper 28 is fed by the paper feeding device 30. The carriage 36 carries a multi-station indexable pen-holding head 48 which supports plural ball-point pens 46. In this arrangement, the ball-point pens 46 are moved in the X-axis direction when the carriage 36 is reciprocated. The drive wire 38, guide rollers 40, carriage drive motor 42, and pulley 44 constitute a major part of a carriage driving device 45 for moving the carriage 36 in the X-axis direction.

The carriage 36 carries a multi-station indexable pen-holding head 48 which supports the plural ball-point pens 46. In this arrangement, the ball-point pens 46 are moved in the X-axis direction when the carriage 36 is reciprocated. With the X-axis movements imparted to the pens 46, in combination with the Y-axis movements of the sheet of paper 28 imparted by the paper feeding device 30, the pens 46 are movable in any directions relative to the sheet of paper 28, whereby desired characters such as letters and symbols, and desired graphs may be recorded, i.e., written or plotted on the sheet of paper 28.

Figure 3:
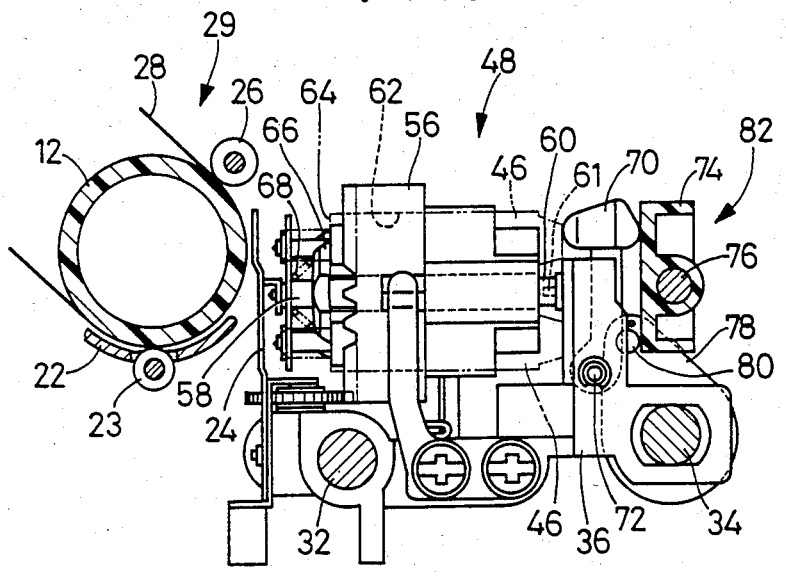
FIG. 3 is an enlarged elevational side view partly in cross section of a pen-holding head and its vicinities.

The multi-station indexable pen-holding head 48 is constructed as shown in FIG. 3. The pen-holding head 48 includes a holder body 56 which is supported on the carriage 36 rotatably or indexably about its axis substantially perpendicular to the axis of the platen 12. Stated more particularly, the pen holder body 56 has a short shaft 58 extending from its one end on the side of the platen 12, and a boss 60 formed at its other end. The short shaft 58 is rotatably supported by the paper guide 24, while a projection 61 extending from the carriage 36 is fitted in a recess formed in the boss 60 of the holder body 56. Thus, the holder body 56 is rotatably supported on the carriage 36. The holder body 56 has four pen holes 62 which are formed in evenly spaced-apart relative with each other circumferentially of the holder body 56. In other words, the pen holes 62 are equiangularly spaced from each other along a circle whole center is aligned with the axis of rotation of the holder body 56. The four pen holes 62 accommodate the respective four ball-point pens 46 of different colors so that they are axially slidable in the holes 62. Thus, the holder body 56 carries the four ball-point pens 46. The end portion of each pen 46 on the side of its writing tip is smaller in diameter than the remaining portion, and terminates at a shoulder 64 on which a biasing force of a return spring 68 is exerted via a commonly used return plate 66.

A hammer 70 is disposed behind the holder body 56, and supported on the carriage 36 pivotably about a pin 72. Behind the hammer 70 is disposed a hammer drive plate 74 which is pivotable about a shaft 76. In the meantime, the guide rod 34 has a lever 78 fixed thereto, and the lever 78 has a pin 80 fixed thereto. When the guide rod 34 is rotated upon activation of a solenoid 170 (FIG. 4) connected thereto, the hammer drive plate 74 is pivoted counterclockwise (as seen in FIG. 3) by the pin 80, and consequently the hammer 70 is pivoted in the same direction. As a result, the hammer 70 advances the currently selected ball-point pen 46 against the biasing force of the return spring 68 until the writing tip of the pen 46 contacts the surface of the sheet of paper 28. At this time, the return plate 66 is flexed by a predetermined angle to permit the pen 46 to advance. The hammer 70, drive plate 74, shaft 76, lever 78, and solenoid 170 cooperate with the return plate 66 and return spring 68, to constitute a pen actuating device 82 for advancing and retracting the currently selected ball-point pen 46 toward and away from the surface of the sheet 28 on the platen 12.

Referring back to FIG. 1, the keyboard 2 will be described in detail. The keyboard 2 has character keys which include a multiplicity of alphabetic keys 90, symbol keys 92 and numeral keys 94, and further has a multiplicity of function keys, as provided on an ordinary typewriter, which include: a space key (space bar) 96; a backspace key 98; a carriage return key 100; a SHIFT key 102; a margin set key 104; a margin release key 106; a tab set key 108; a tab key 110; a CODE key 112; carriage-jog keys 114; 116 for moving the carriage 36 (pens 46); and platen-jog keys 118, 120 for rotating the platen 12 (for feeding the paper 28). Further, the keyboard 2 has a " ｶﾅ " (kana) key 124 for placing the keyboard 2 selectively in a "KANA" mode or in an "ALPHABET" mode. As will be described in detail, the "ALPHABET" mode consists of an "ENGLISH LOWER-CASE" mode and an "ENGLISH UPPER-CASE" mode. The keyboard 2 further has a GRAPH key 126 for placing the recording apparatus selectively in a WRITING mode for writing characters, or in a PLOTTING mode for plotting graphs. In an upper central part of the keyboard 2, there is provided a liquid crystal display 140, which displays keyed-in characters in such a manner that the already displayed characters are shifted one position to the left each time a new character is keyed in through the character keys.

Figure 4:
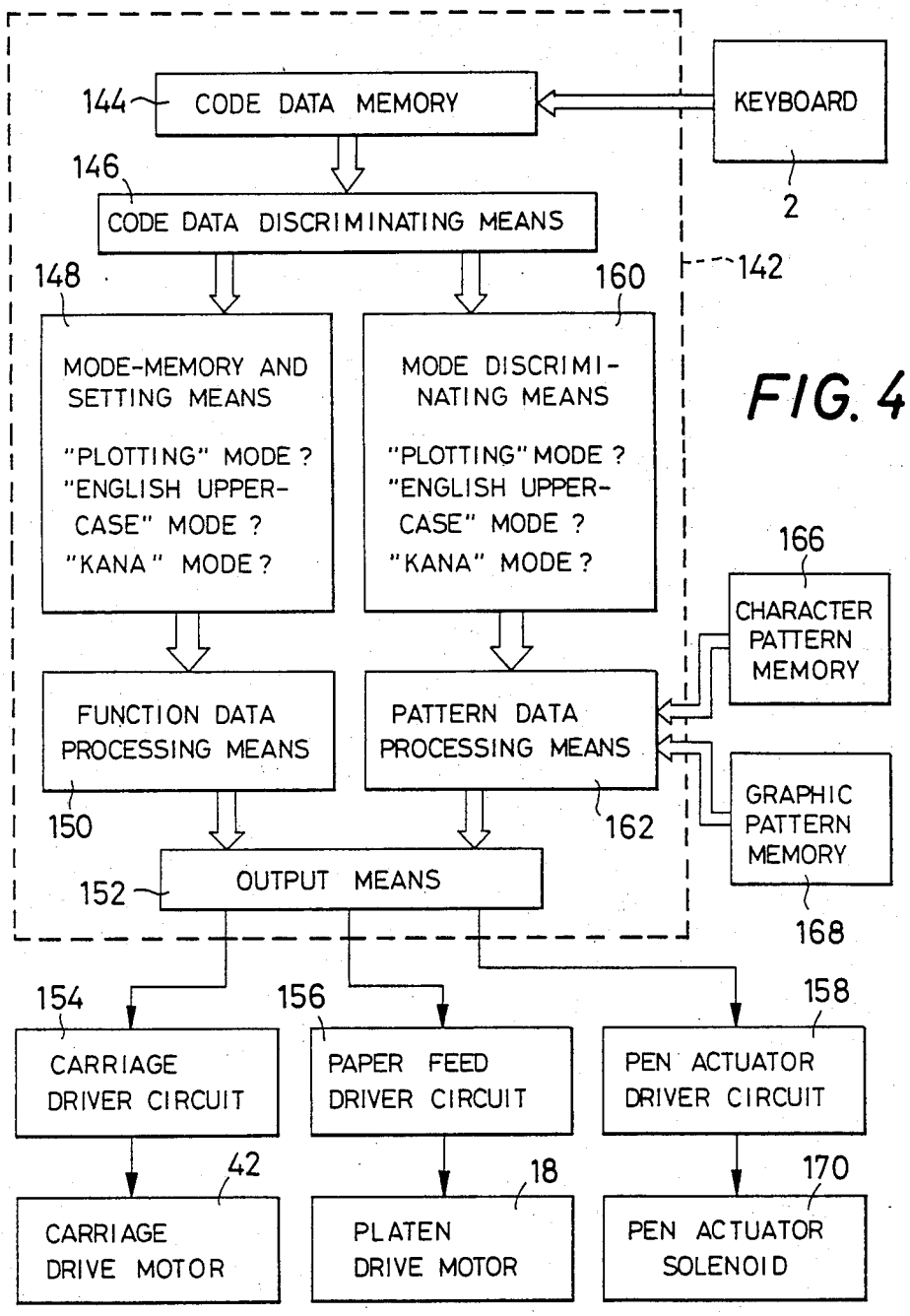
FIG. 4 is a block diagram of a control system for the recording apparatus of FIG. 1, schematically showing an arrangement of a central processing unit which constitutes a major part of the control system.

The instant recording apparatus is controlled by a control system which is mainly constituted by a central processing unit (hereinafter referred to as CPU), as generally indicated at 142 in FIG. 4. Although this CPU 142 controls all phases of operation of the recording apparatus, the block diagram of FIG. 4 schematically illustrates only the arrangement of the CPU 142 for performing its functions associated with the selection of a mode of operation of the recording apparatus itself (WRITING or PLOTTING mode), and its functions associated with the selection of a mode of operation of the keyboard 2 ("ENGLISH LOWER-CASE", "ENGLISH UPPER-CASE" or "KANA" mode). In the figure, reference numeral 144 designates a code data memory which temporarily stores coded data received from the keyboard 2 upon operation of each key provided thereon. The coded data temporarily stored in the code data memory 144 is checked by code data discriminating means 146, to find whether the coded data corresponds to any one of the character keys or any one of the function keys. Namely, the code data discriminating means 146 checks if the key operated is a character key or a function key. If the checking by the discriminating means 146 indicates that a function key has been operated, i.e., the stored coded data corresponds to a function key, a mode of operation of the apparatus or the keyboard 2, viz., PLOTTING mode, "ENGLISH UPPER-CASE" mode or "KANA" mode is established by mode-memory and setting means 148. Normally, the apparatus is placed in the WRITING mode, and the keyboard 2 is placed in the "ENGLISH LOWER-CASE" mode. With the appropriate mode established, function-data processing means 150 executes data processing necessary to achieve the function of the operated function key. The output of the processing means 150 is fed through output means 152 to a carriage driver circuit 154, a paper feed driver circuit 156 and a pen actuator driver circuit 158.

In the case where the checking by the code data discriminating means 146 indicates that a character key has been operated, mode discriminating means 160 operates to find a currently selected mode of the keyboard 2. Then, pattern-data processing means 162 reads out character pattern data of graphic pattern data from a character pattern memory 166 or from a graphic pattern memory 168, depending upon the currently selected mode found by the mode discriminating means 160, so that the output of the processing means 162 corresponds to the operated character key. The character pattern memory 166 stores sets of character pattern data representative of patterns of the individual characters that can be written on this recording apparatus. The graphic pattern memory 168 stores at least one set of graphic pattern data representative of a graphic pattern such as a circular graph, bar graph or broken-line graph. The data processing by the processing means 162 will be described later in greater detail. The output signals from the signal-output means 152 are applied to the driver circuits 154, 156 and 158.

The above driver circuits 154, 156, 158 are connected to the previously indicated carriage drive motor 42, platen drive motor 18 and pen actuator solenoid 170, whereby these motors 42, 18 and solenoid 170 are controlled by the CPU 142 to accomplish an intented writing of characters or plotting of a graph according to data entries through the keyboard 2 by the operator.

As previously indicated, the keyboard 2 is normally placed in the "ENGLISH LOWER-CASE" mode wherein numerals, some of the symbols and English lower-case letters can be keyed in through the appropriate character keys. These characters available in the normal "ENGLISH LOWER-CASE" mode are indicated by corresponding legends provided on the lower-left corner of the appropriate character keys. In FIG. 1, however, the legends of the English lower-case letters are not shown. When the SHIFT key 102 is pressed alone to its shift position, the keyboard 2 is placed in the "ENGLISH UPPER-CASE" mode as long as the SHIFT key 102 is held pressed by the operator. The SHIFT key 102 is locked in its shift position by pressing the LOCK key 122. The SHIFT key 102 locked in its shift position is unlocked to its non-shift position by pressing the LOCK key 122 locking the SHIFT key 102. In the "ENGLISH UPPER-CASE" mode, it is possible to key in English upper-case letters and symbols indicated on the upper-left corner of the appropriate character keys. These two modes "ENGLISH LOWER-CASE" and "ENGLISH UPPER-CASE" constitute the previously indicated "ALPHABET" mode as compared to the "KANA" mode which is a special mode. In other words, English lower-case and upper-case letters can be entered through the keyboard 2 in the "ALPHABET" mode by selectively establishing the "ENGLISH LOWER-CASE" and "ENGLISH UPPER-CASE" modes with the SHIFT key 102. This basic "ALPHABET" mode is changed to the "KANA" mode by pressing the " ｶﾅ " ("kana") key 124. In the "KANA" mode, it is possible to enter Japanese "katakana" letters which are indicated on the lower-right corner of the appropriate character keys. The keyboard 2 is restored to the "ALPHABET" mode by pressing the " ｶﾅ " key 124 again. Further, it is possible to establish the "ENGLISH UPPER-CASE" mode by pressing the SHIFT key 102 while the "KANA" mode is selected. Although it is possible to enter numerals in the "ENGLISH LOWER-CASE" mode through the numeral keys 94 as previously indicated, it is not possible to effect the entry of numerals while the keyboard 2 is placed in the special "KANA" mode, or in the alphabetic "ENGLISH UPPER-CASE" mode. In this embodiment, the "ENGLISH LOWER-CASE" mode is a normally-selected, first mode of the keyboard 2, and the "ENGLISH UPPER-CASE" mode or special "KANA" mode is a second mode of the keyboard 2 in which no numerals can be keyed in through the character keys.

The WRITING mode of the recording apparatus in which the keyboard 2 may be placed in the first or second mode as discussed above, may be replaced by the PLOTTING mode by pressing the GRAPH key 126. With the GRAPH key 126 pressed again, the apparatus is restored to the normal WRITING mode.

Figure 5:
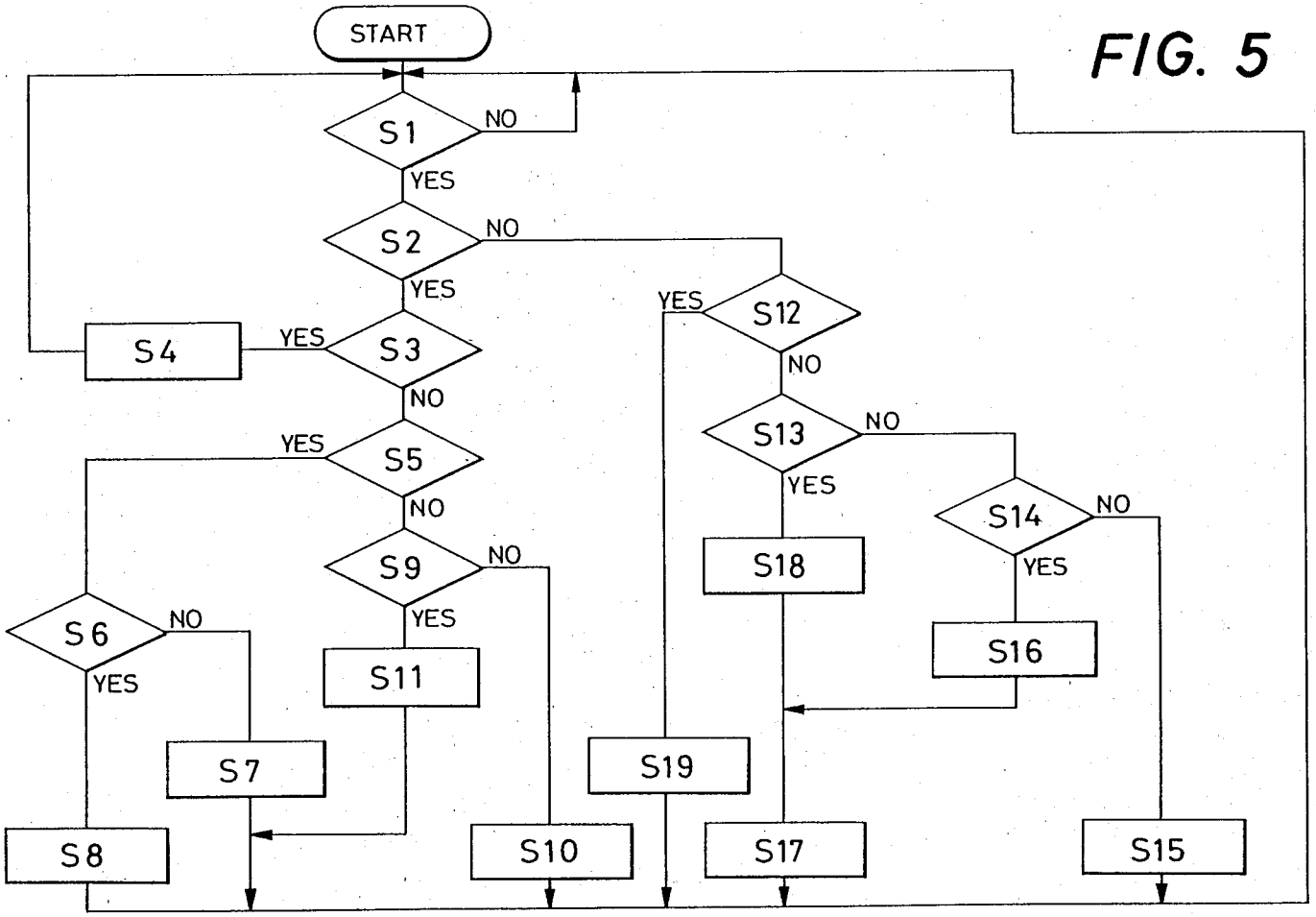

Referring next to the flow chart of FIG. 5, the operation of the recording apparatus will be described, mainly in connection with establishment and cancellation of the above-indicated various modes of the apparatus and keyboard 2. Upon application of power to the recording apparatus, the CPU 142 goes to step S1 which is repeatedly executed to check if any key on the keyboard 2 has been operated. When any key has been operated, step S1 is followed by step S2 wherein the code data discriminating means 146 checks if coded data stored in the code data memory 144 upon operation of the key corresponds to any one of the function keys. If the checking in step S2 indicates that a function key has been operated, the CPU 142 goes to step S3 to check if the operated function key is the GRAPH key 126. The operation of the GRAPH key 126 causes the CPU 142 to go to step S4 wherein a "MODE" flag is set or reset to change the currently selected mode to the other, i.e., to change the WRITING mode to the PLOTTING mode, or vice versa.

In the event the checking in step S3 indicates that the GRAPH key 126 has not been operated, the CPU 142 executes step S5 to check if the operated function key is the " ｶﾅ " key 124. If the checking in this step S5 reveals the operation of the " ｶﾅ " key 124, step S6 is executed to check if the "KANA" mode is currently selected or not. If the "KANA" mode is not selected, a "SHIFT" flag is cleared and the "KANA" mode is established in step S7. In the case where the judgement in step S6 is affirmative (YES), that is, if the "KANA" mode is currently selected, the "KANA" mode is cancelled.

If the judgement in step S5 is negative (NO), step S5 is followed by step S9 to check if the operated function key is the SHIFT key 102. If the operated function key is not the SHIFT key 102, namely, if the operated function key is any one of function keys such as the space key 96, backspace key 98 and carriage return key 100, step S9 is followed by step S10 to execute the function of such operated function key other than the GRAPH, " ｶﾅ " and SHIFT keys 126, 124, 102. In the case where the SHIFT key 102 is operated, step S9 is followed by step S11 to set the "SHIFT" flag to establish the "ENGLISH UPPER-CASE" mode.

The foregoing description has referred to the operations in the case where a function key is operated in step S1. On the other hand, when a character key is operated in step S1, the judgement in step S2 becomes negative (NO) and the CPU 142 goes to step S12 to check if the recording apparatus is placed in the PLOTTING mode or not. If the apparatus is not placed in the PLOTTING mode, that is, if the WRITING mode is currently established, step S12 is followed by step S13 wherein the mode discriminating means 160 checks if the "SHIFT" flag, i.e., "ENGLISH UPPER-CASE" mode is established or not. If not, the CPU 142 goes to step S14 wherein the mode discriminating means 160 checks if the keyboard 2 is currently placed in the "KANA" mode or not. If the checking in step S14 indicates that the "KANA" mode is not currently established, i.e., if the "NON-SHIFT" mode is currently selected, the CPU 142 goes to step S15 wherein the pattern-data processing means 162 reads out from the character pattern memory 166 the set of character pattern data corresponding to the operated character key, i.e., corresponding to the coded data which is temporarily stored in the code data memory 144. The processing means 162 processes the read-out character pattern data, and the processed characacter pattern data is fed to the output means 152. Thus, the driver circuits 154, 156 and 158 are operated according to the output signals from the signal-output means 152, whereby the character corresponding to the operated character key is written on the sheet of paper 28 in the "ENGLISH LOWER-CASE" mode. In other words, the character indicated on the lower-left corner of the operated character key is written.

In the case where the checking by the mode discriminating means 160 indicates that the "KANA" mode is currently selected, step S14 is followed by step S16 wherein the pattern-data processing means 162 converts the coded data in the code data memory 144 into the corresponding "kana-mode" coded data. Then, the CPU 142 goes to step S17 wherein the pattern-data processing means 162 reads out from the character pattern memory 166 the set of character pattern data corresponding to the "kana-mode" coded data. In other words, the processing means 162 retrieves the character pattern data representative of a Japanese "kana" letter which is indicated on the lower-right corner of the operated character key. The "kana" letter is written in the "KANA" mode according to the read-out character pattern data.

In the case where the checking by the mode discriminating means 160 in step S13 indicates that the "SHIFT" flag is currently established, the CPU 142 goes to step S18 wherein the pattern-data processing 162 converts the coded data in the code data memory 144 into the corresponding "upper-case mode" coded data. In this "ENGLISH UPPER-CASE" mode, the pattern-data processing means 162 retrieves in step S17 the set of character pattern data which corresponds to the obtained "upper-case mode" coded data. While the "SHIFT" flag is established, the character indicated on the upper-left corner of the operated character key is written in the "ENGLISH UPPER-CASE" mode, irrespective of whether the "KANA" mode is selected or not.

When the checking in step S12 reveals that the PLOTTING mode is currently selected, step S12 is followed by step S19 wherein a PLOTTING mode of operation is performed. Stated in more detail, a desired one of graphic patterns stored in the graphic pattern memory 168 is selected by operating the corresponding one of the numeral keys 94. In this embodiment, numerals "1" through "8" are assigned to eight different graphic patterns as indicated above the corresponding numeral keys 94 (as shown in FIG. 1). Successively, up to twelve numerical values to be presented in the selected graph are entered through the appropriate numeral keys 94, decimal point symbol key 94, and the carriage return key 100 which serves in the PLOTTING mode as an ENTER key. When the space key 96 which serves as a START key in the PLOTTING mode is operated, a graph is plotted based on the entered numerical data, and on the graphic pattern data read out from the graphic pattern memory 168. While the WRITING mode of operation is performed in one of the "ENGLISH LOWER-CASE", "ENGLISH UPPER-CASE" and "KANA" modes are previously described, the PLOTTING mode of operation is effected always in the normal "ENGLISH LOWER-CASE" mode, without execution of steps S11–S18. Consequently, when the numeral keys 94 are pressed, the coded data corresponding to the numerals "0" through "9" are fed to the pattern-data processing means 162.

Therefore, when the mode of operation of the recording apparatus is changed from the WRITING mode to the PLOTTING mode, the operator does not have to pay attention to the currently active mode of the keyboard 2, that is, there is no need to check if the keyboard 2 is placed in the "ALPHABET" mode or special "KANA" mode, or placed in the "ENGLISH LOWER-CASE" mode or "ENGLISH UPPER-CASE"

mode. Stated the other way, the selection of the PLOTTING mode automatically selects the normal "ENGLISH LOWER-CASE" mode wherein it is possible to enter desired numerical values through the numeral keys 94.

Although a PLOTTING mode of operation is always effected in the "ENGLISH LOWER-CASE" mode (of the "ALPHABET" mode), the "SHIFT" flag or the "KANA" flag which was established before the selection of the PLOTTING mode will not be cleared or cancelled as a result of selection of the PLOTTING mode. Accordingly, when the recording apparatus is restored to the writing mode after completion of a plotting operation, the keyboard 2 is automatically restored to its original mode which was established before the PLOTTING mode was selected. Hence, the operator may resume or continue the interrupted writing mode of operation, as if the "PLOTTING" mode were not selected, or as if the writing operation were not interrupted by an intervening plotting operation.

In the interest of brevity and simplification, the full detail of the operations in step S15, S17 and S19 is not described herein, since the detailed description of these steps is not essential to the understanding of the subject matter of the invention. These aspects of operation are described in greater detail in applications Ser. Nos. 675,287 and 675,654, filed Nov. 27 and Nov. 28, 1984, respectively, both assigned to the assignee of the present application.

As is apparent from the foregoing description, the instant recording apparatus is adapted such that the CPU 142, while in the PLOTTING mode, skips or by-passes the steps for converting the coded data from the keyboard 2 into the corresponding "upper-case mode" or "kana-mode" coded data. As a result, the keyboard 2 is automatically placed in the first mode, i.e., "ENGLISH LOWER-CASE" mode when the apparatus is set in the PLOTTING mode. This arrangement eliminates the need of cancelling the "ENGLISH UPPER-CASE" mode or "KANA" mode which has been established in the preceding writing mode of operation. Thus, the "ENGLISH LOWER-CASE", "ENGLISH UPPER-CASE" or "KANA" mode which was established prior to the plotting operation is maintained in the mode-memory and setting means 148. When the recording apparatus is restored to the WRITING mode at the end of the intended plotting operation, the keyboard 2 is automatically restored to its original mode, that is, to one of the "ALPHABET" modes and "KANA" mode, which was active before the apparatus was placed in the PLOTTING mode. It will be understood, therefore, that the CPU 142 which skips steps S11–S18 in the plotting mode provides automatic mode setting means for placing the keyboard 2 into the first mode ("ENGLISH LOWER-CASE" mode) upon selection of the plotting mode, and for placing the keyboard 2 into the first mode or the second mode ("ENGLISH UPPER-CASE" mode or "KANA" mode) which has been established before the plotting mode is selected. However, it is possible to use a memory which stores, during a plotting operation, mode data indicative of one of the first and second modes which has been established in the preceding writing mode. In this case, the previously active second mode, i.e., "ENGLISH UPPER-CASE" or "KANA" mode is actually cancelled upon selection of the PLOTTING mode, but the keyboard 2 can be restored to the previously active mode registered in the memory, when the recording apparatus is restored to the WRITING mode.

The arrangement according to the invention is particularly effective and advantageous when the keyboard of a recording apparatus is operable in one of three or more different modes, as in the illustrated embodiment wherein the keyboard 2 is operable in one of three modes ("ENGLISH LOWER-CASE", "ENGLISH UPPER CASE" and "KANA" modes). However, the principle of the present invention may be applied, with a significant advantage, to a recording apparatus wherein the keyboard is operable in one of two modes, e.g., lower-case and upper-case modes.

While the present invention has bee described in its preferred embodiment, it is to be understood that the invention is not limited thereto, but may be otherwise embodied with various changes, modification and improvements in the keyboard, recording mechanism, control system and control programs, which may occur to those skilled in the art in the light of the foregoing teachings, and which do not exceed the scope of the invention as expressed in the appended claims.

What is claimed is:

1. A recording apparatus capable of writing characters in a writing mode and plotting graphs in a plotting mode, comprising:

a keyboard having a multiplicity of keys including character keys corresponding to said characters, said keyboard being operable in a first mode in which at least numerals can be keyed in, and in a second mode in which letters and symbols can be keyed in;

a paper feeding device for supporting and feeding a sheet of paper in opposite directions;

a carriage supporting a writing instrument, and movable in a direction perpendicular to a line of feed of said sheet of paper;

control means for controlling the operations of said paper feeding device and said carriage, to write with said writing instrument in said writing mode the characters which are keyed in through said character keys with said keyboard placed selectively in said first or second mode, and to plot the graphs with said writing instrument in said plotting mode based on the operations of said multiplicity of keys with said keyboard placed in said first mode;

mode-memory means for storing, upon selection of said plotting mode, mode data indicative of one of said first and second modes which has been established in the writing mode before said selection of the plotting mode; and automatic mode setting means for placing said keyboard into said first mode upon said selection of the plotting mode, and placing said keyboard, upon selection of said writing mode, into said one of the first and second modes which is represented by said mode data stored in said mode-memory means.

2. The recording apparatus of claim 1, wherein said first mode of the keyboard is a non-shift mode in which lower-case letters are keyed in through said character keys, and said second mode thereof is a shift mode in which upper-case letters are keyed in through said character keys, said keyboard having operator-controlled shift means for placing said keyboard in said shift mode, and being placed in said non-shift mode while said shift means is not operated.

3. The recording apparatus of claim 2, wherein said shift means comprises a shift key operable between a non-shift position to select said non-shift mode, and a shift position to select said shift mode, said keyboard further having a lock key for locking said shift key in said shift position, said shift key locked by said lock key being unlocked when the lock key locking the shift key is operated.

4. The recording apparatus of claim 1, wherein said first mode is an English lower-case mode in which English lower-case letters are keyed in through said character keys, and said second mode includes an English upper-case mode in which English upper-case letters are keyed in through said character keys, and a special mode in which letters except said English lower-case and upper-case letters are keyed in through said character keys.

5. The recording apparatus of claim 4, wherein said keyboard has a mode selector key for selecting said English upper-case mode while the mode selector key is operated, and another mode selector key for selecting said English lower-case mode and said special mode alterntely upon repeated depression thereof.

6. The recording apparatus of claim 1, wherein said keyboard has a mode selector key for selecting and writing and plotting modes alternately upon repeated depression thereof.

7. The recording apparatus of claim 1, wherein said control means comprises:

a character pattern memory storing sets of character pattern data representative of patterns of said characters;

code data memory means for temporarily storing coded data received from said keyboard upon operation at each of said multiplicity of keys;

code data discriminating means for checking whether said coded data corresponds to one of said character keys or one of function keys on the keyboard;

mode discriminating means for checking whether the keyboard is currently placed in said first mode or in said second mode, if the checking by the code data discriminating means indicates that said coded data corresponds to said one of the character keys;

pattern-data processing means which, if the checking by the mode discriminating means indicates that the keyboard is placed in said first mode, reads out from said character pattern memory the set of character pattern data corresponding to the coded data stored in said code-data memory means, and if the checking by the mode discriminating means indicates that the keyboard is placed in said second mode, converts said coded data into corresponding second-mode coded data, and reads out from said character pattern memory the set of character pattern data corresponding to said corresponding second-mode coded data, said pattern-data processing means processing the read-out character pattern data for writing the characters represented by said read-out character pattern data;

signal-output means for providing output signals corresponding to the character pattern data processed by said pattern-data processing means; and driver means responsive to said output signals from said signal-output means to drive said paper feeding device and said carriage.

8. The recording apparatus of claim 7 wherein if the checking by said code-data discriminating means indicates that said coded data corresponds to said one of function keys, said automatic mode setting means checks whether said one of function keys is a mode selector key for establishing and cancelling said plotting mode, said automatic mode setting means operating when the checking indicates that said one of function keys is said mode selector key.

9. The recording apparatus of claim 1 wherein said mode-memory means stores said mode data irrespective of whether the recording apparatus is placed in said writing mode or in said plotting mode, said control means comprising a character pattern memory storing sets of character pattern data representative of said characters, and further comprising pattern-data processing means which, if the keyboard is placed in said second mode, converts said coded data into corresponding second-mode coded data, and reads out from said character pattern memory the set of character pattern data corresponding to said corresponding second-mode coded data, said automatic mode setting means inhibiting said pattern-data processing means from converting said coded data into said corresponding second-mode coded data, irrespective of the contents of said mode data in said mode-memory means, while the recording apparatus is placed in said plotting mode.

* * * * *